United States Patent [19]

Keller

[11] Patent Number: 4,912,946

[45] Date of Patent: Apr. 3, 1990

[54] STEAMER

[75] Inventor: Walter Keller, Willich, Fed. Rep. of Germany

[73] Assignee: Eduard Küsters Maschinenfabrik GmbH & Co KG, Krefeld, Fed. Rep. of Germany

[21] Appl. No.: 260,939

[22] Filed: Oct. 21, 1988

[30] Foreign Application Priority Data

Oct. 23, 1987 [DE] Fed. Rep. of Germany ..... 3736017

[51] Int. Cl.[4] ..... D06B 23/30

[52] U.S. Cl. ..... 68/5 D; 68/5 E; 15/88; 15/246; 118/70; 198/496

[58] Field of Search ..... 68/5 D, 5 E; 15/88, 15/246; 198/496, 498; 134/104.1, 172; 118/70

[56] References Cited

U.S. PATENT DOCUMENTS

| | | | |
|---|---|---|---|
| 1,791,728 | 2/1931 | Linfesty | 198/496 |
| 2,989,026 | 6/1961 | Gardner et al. | 68/5 E |
| 3,040,702 | 6/1962 | Eng et al. | 68/5 E |
| 3,665,531 | 5/1972 | Sando et al. . | |
| 3,762,870 | 10/1973 | Probst et al. | 8/151 |
| 3,851,753 | 12/1974 | Lazzarini et al. | 198/498 |
| 3,989,001 | 11/1976 | Brigham et al. | 118/70 |
| 4,019,217 | 4/1977 | Schinke . | |
| 4,051,699 | 10/1977 | Carpenter, Jr. | 68/5 D |
| 4,112,713 | 9/1978 | Sando et al. | 68/5 E |
| 4,121,441 | 10/1978 | Sando et al. | 68/5 E |
| 4,184,346 | 1/1980 | Sando et al. | 68/5 E |

FOREIGN PATENT DOCUMENTS

| | | | |
|---|---|---|---|
| 1157187 | 11/1963 | Fed. Rep. of Germany | 68/53 |
| 1410823 | 12/1968 | Fed. Rep. of Germany . | |
| 2164899 | 7/1973 | Fed. Rep. of Germany . | |
| 2456401 | 8/1976 | Fed. Rep. of Germany . | |
| 533716 | 2/1973 | Switzerland . | |
| 1352099 | 5/1974 | United Kingdom . | |

*Primary Examiner*—Frankie L. Stinson
*Attorney, Agent, or Firm*—Kenyon & Kenyon

[57] ABSTRACT

A steamer contains cleaning elements formed as rotating brushes or nozzle arrangments that extend over the length of guide rollers conducting a textile web through the steamer. The cleaning elements are movable along rows of guide rollers to clean the guide rollers.

19 Claims, 3 Drawing Sheets

STEAMER

BACKGROUND OF THE INVENTION

The invention generally relates to steaming apparatus for treating webs of material, e.g., fabric webs, and more particularly to a steamer having a web cleaning device.

Most steamers comprise rows of several, mutually parallel, guide rollers. For example, in a horizontal steamer a row of guide rollers is arranged in a horizontal plane, while in a loop steamer, an upper row of rollers is arranged in a horizontal plane with an additional row of rollers arranged in a horizontal plane therebelow. The invention, however, is not limited to steamers in which the guide rollers of a given row all lie in a horizontal plane. Rather, the term "row" as used herein designates any sequence or series of mutually parallel, guide rollers that lie at substantially the same level.

Known steamers generally have cleaning means in the form of spray nozzles that are mounted on the side walls of the steamer to prevent dripping onto the web. The nozzles are directed against the guide rollers for cleaning them by spraying. Residues of dye and textile additives remaining on the guide rollers can be removed in this manner as long as the residues are still moist. After drying has taken place, removal is possible only with the use of aggressive chemicals, which are different for removal of various types of dyes and textile aids.

Other types of impurities may become deposited on the guide rollers of a steamer, such as waterglass compounds and fuzz. These types of impurities can not be removed by a side-mounted spray nozzle. Even after short running times, the rollers must be treated with brushes or scrapers. For this reason, prompt cleaning in steamers is still predominantly manual work today.

The invention is directed to the problem of providing a steamer in which web cleaning takes place faster and more effectively than in the steamers heretofore known in the prior art.

SUMMARY OF THE INVENTION

The invention solves this problem by providing a steaming apparatus for textile webs having a housing containing at least one row of mutually parallel guide rollers around which a textile web is passed and a cleaning device associated with said at least one row to clean the periphery of the guide rollers. The cleaning device comprises a cleaning element supported for movement along said at least one row of guide rollers over the length of the guide rollers in a direction transverse to the longitudinal axes of the mutually parallel guide rollers.

The cleaning element is movable along the guide rollers to act thereon at a close range to remove adhering impurities from the guide rollers more effectively than is possible by spraying from the side walls of the steamer. The invention obviates the need for manual operations in the steamer since the process may take place automatically.

The cleaning element is movable outside the row of guide rollers to an inactive position to ensure that the drops of condensed liquid formed on the cleaning element during operation of the steamer do not fall onto the fabric web and thereby cause defects on the web. As an additional protection a catch basin may be provided underneath the cleaning element in the inactive position.

In principle, the cleaning element does not have to extend over the length of the guide rollers in their longitudinal direction if it is alternately movable back and forth in this direction, in addition to being movable in a direction transverse the longitudinal direction. The additional expense connected with provision of movement along two axes can be obviated by provision of a cleaning element that extends over the longitudinal length of the guide rollers to be cleaned. This allows the cleaning element to be fixedly mounted in the longitudinal direction to simplify the apparatus.

The cleaning element may be guided on a path parallel to the row of guide rollers. The guide path may be defined by a rail along which the cleaning element is displaceable by means of an endless drive chain or other drive means. The cleaning element may be supported for rotation about an axis parallel to longitudinal axes of the guide rollers and movable along the row of rollers such that the periphery of the cleaning element abuts the rollers. Direct contact between the cleaning element and the guide rollers produces a mechanical action that wipes off the impurities on the guide rollers. The rotating cleaning elements may be formed as brushes or rotating bodies having a foam material covering, such as plastic.

To support the cleaning action by washing away the wiped off impurities and cleaning the cleaning elements themselves, spray nozzle arrangements may be provided that either are fixed to the sidewalls of the housing or supported for movement along with the cleaning element.

In another embodiment, the cleaning element may comprise a nozzle arrangement that may be of a known design, such as high-pressure cleaning system, to effectively clean the guide rollers without direct mechanical contact between the cleaning element and guide rollers.

If the steamer is provided with horizontal rows of guide rollers, e.g., as in a horizontal steamer or loop steamer, the cleaning element may be movable above or below the upper row of rollers and, if provided, along a lower row of guide rollers. The path of the cleaning element runs parallel to the row of guide rollers. The cleaning element successively abuts against the guide rollers of the row in a direction parallel to their longitudinal axes to wipe their surfaces clean as it rotates.

In the loop steamer arrangement, the bottom row of guide rollers may be constructed to be vertically pulled up between the guide rollers of the upper row such that a cleaning element can be moved above or below the now coplanar rows of the guide rollers. Although this construction adds additional expense because of pulling up the lower row of guide rollers, it enables elimination of the cleaning element for the bottom row of guide rollers. The upper cleaning element may clean both the upper and lower rollers at the same time when the latter are pulled up between the upper rollers. However, the most important advantage of provision of a loop steamer with bottom guide rollers that can be pulled up between the upper guide rollers is that a cleaning element may be provided above and below the row of the upper guide rollers to enable cleaning to occur without having to run the steamer empty, i.e., without having to conduct the web completely out of the housing. In this construction, the fabric web is guided over the upper guide rollers to present exposed peripheral surfaces at the bottom of the rollers to be cleaned by the lower cleaning element. Furthermore, the web is guided under the lower guide rollers, which have been pulled up between the upper guide rollers, to expose peripheral surfaces at the top of the rollers to be cleaned by the upper cleaning element. Therefore, both rows of guide rollers can be reached by the cleaning elements. Furthermore, cleaning can be carried out immediately after passage of a given yardage of the textile web without having to wait for the steamer to cool and without having to rethread the beginning of the new web after the cleaning occurs. This considerably accelerates the cleaning process to meet the frequently occurring demand for steaming and cleaning equipment that can process relatively short yardages of different fabrics in quick succession.

Provision of lower guide rollers that are pulled up between the guide rollers of the upper row of a loop steamer are, taken by itself, disclosed in DE-OS No. 1410823 and DE-AS No. 2164899. But, in these patents the pulling up of the lower guide rollers is for entirely different purposes, namely, for changing the fabric run (DE-AS No. 2164899) and for facilitating threading (DE-OS No. 1410823), respectively.

In a loop steamer treating webs having relatively large fabric contents, at least one of the upper guide rollers must be driven such that the web tension is not excessive. Heretofore, the drive has been controlled by a compensator, which in known steamers often was designed as a vibration compensator. Provision of such a compensator in the steamer of the invention would hinder the movement of the cleaning elements of the invention. Hence, a group compensator is provided that comprises a vertical movable group of lower rollers that precedes the driven upper roller in the running direction of the web for adjusting the web tension. This arrangement permits provision of a compensator without impeding the movement of the cleaning element.

Embodiments of the invention are schematically illustrated in the drawing and described in detail below.

DETAILED DESCRIPTION

Figure 1:
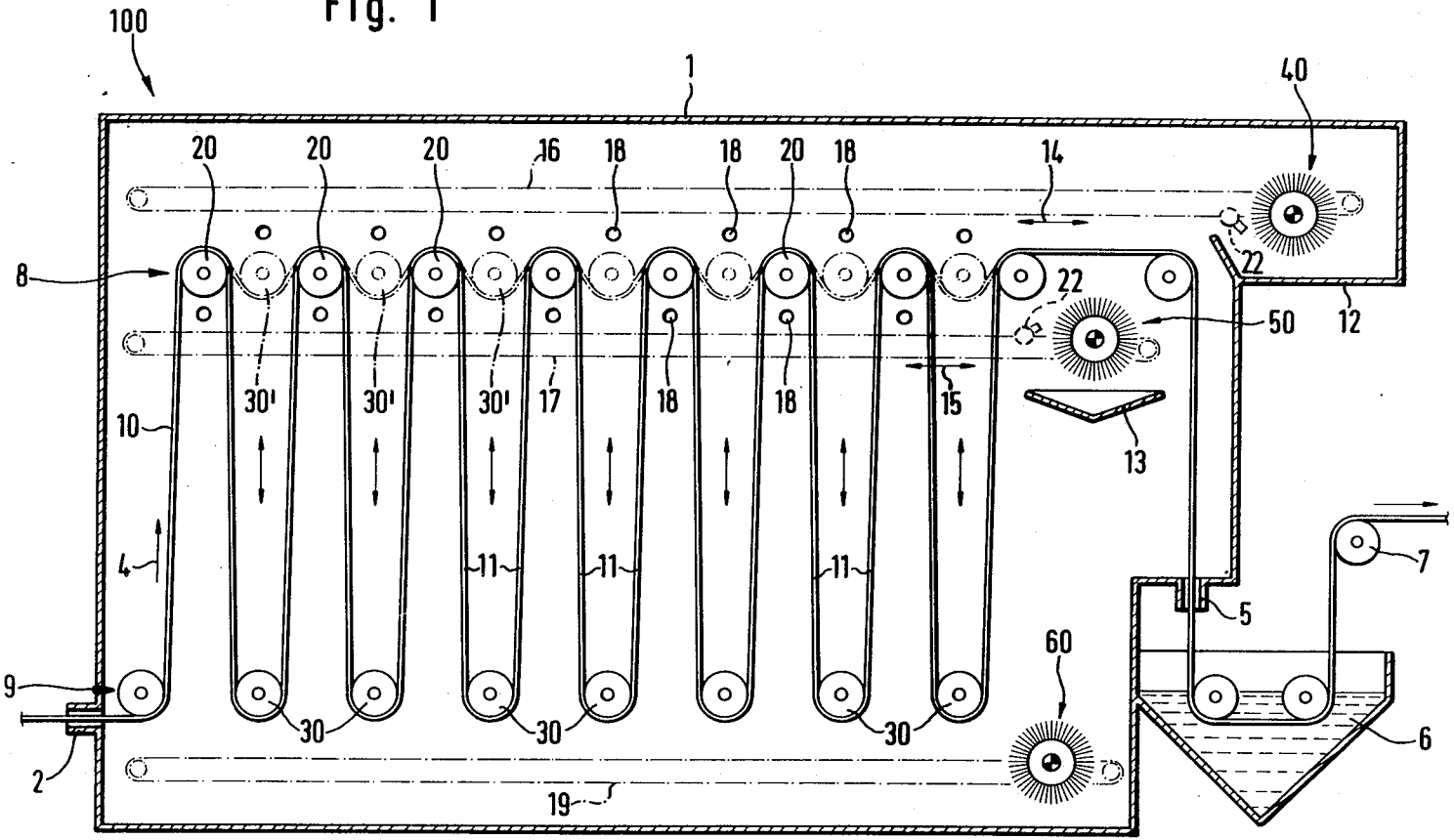
FIG. 1 shows a vertical longitudinal section through a loop steamer constructed according to the principles of the invention.

The steamer designated at 100 in FIG. 1 is a loop steamer having a box-like housing 1 into which, for example, a fabric web 10 enters at an inlet 2 in the direction of arrow 4, i.e., the running direction of the web. The fabric web 10 exits from the steamer at an outlet 5 whereafter it passes through a rinse bath 6 and over a guide roller 7 before being conveyed for further treatment. The means contained in housing 1 for creating the steam atmosphere for treating the web and the construction of inlet 2 and outlet 5 are well known in the art and not shown in detail.

The steamer 100 comprises an upper row 8 of guide rollers 20 as well as a lower row 9 of guide rollers 30 that may be arranged in a horizontal plane in housing 1. The spacing between the guide rollers 20 in a direction perpendicular to their longitudinal axes is somewhat greater than the diameter of the guide rollers 30. This spacing allows the guide rollers 30 to be pulled up between the guide rollers 20 to a coplanar position therewith, along guideways not shown, by a conventional drive means. The pulled up position is indicated at 30' by the broken lines shown in FIG. 1.

During operation of the steamer, the fabric web 10 is conducted in the manner shown in FIG. 1 through the steamer 100 in vertical hanging loops 11 to produce a large web surface contact area inside the steamer. After a given yardage of web material has run through the steamer and before another yardage, which may be of a different material and may be dyed differently, is subsequently treated, the guide rollers 20, 30 must be cleaned. For this purpose the lower guide rollers 30 are pulled up into the upper position 30' such that they are between the upper guide rollers 20, as previously discussed. To clean the guide rollers 20, 30', cleaning elements 40, 50 are provided above and below the row 8, respectively. The elements 40, 50 each rotate about an axis that is parallel to the longitudinal axes of the guide rollers 20, 30'. In the position shown in the drawing, the cleaning elements 40, 50 are in their inactive position in which they are located to the right, outside the hanging loops 11. In this manner, liquid dripping from the cleaning elements 40, 50 cannot fall onto the fabric web 10 when the steamer 100 is in operation. In addition, below the cleaning elements 40, 50 catch basins 12, 13 are provided for collecting and subsequently discharging any dripping liquid.

From the inactive position shown, the cleaning elements 40, 50 can be moved back and forth in the direction of arrows 14, 15 along a horizontal path defined by a guide rail (not shown). The path corresponds to the indicated course of endless, i.e., closed loop, drive chains 16, 17, which are operable to displace the cleaning elements 40, 50 in the direction of arrows 14, 15 parallel to each other along row 8. The cleaning elements 40, 50 are guided at a vertical distance from row 8 such that they graze the periphery of the guide rollers 20, 30' to wipe off the impurities thereon as they rotate. The fabric web 10 is slowly pulled forward during the cleaning process to ensure that different areas of the periphery of the guide rollers contact the cleaning elements 40, 50. This process is carried out in conjunction with nozzles 18, schematically indicated in FIG. 1 as small circles, that are provided on the interior side walls of the steamer 100 for directing a water jet, in a direction extending perpendicular to the steamer 100, onto the circumference of the guide rollers 20, 30'.

Figure 2:
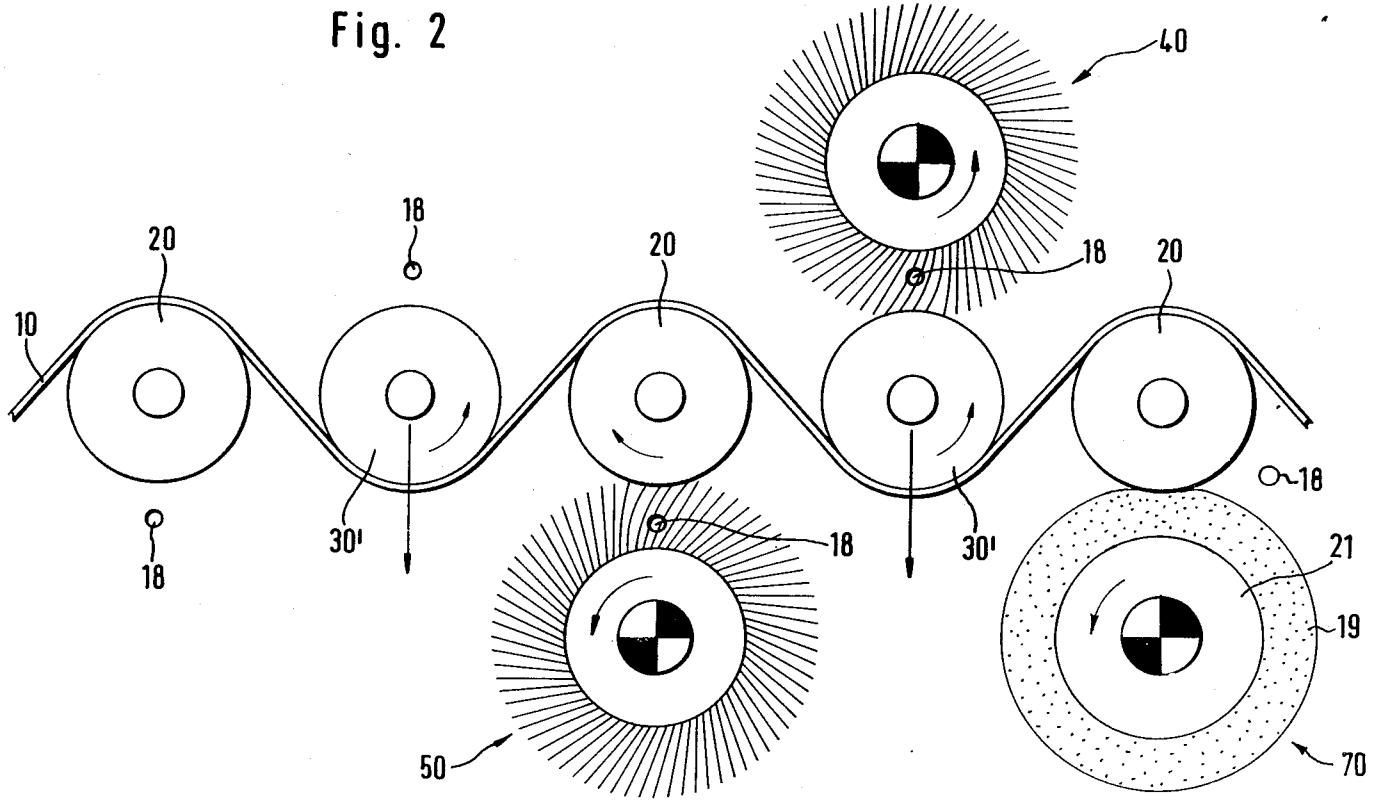
FIG. 2 shows, on a larger scale a portion of the upper row of guide rollers illustrated in FIG. 1 with the cleaning elements in operation.

As can be seen from FIG. 2, with the cleaning arrangement described herein the aggregate surface area of the guide rollers 20, 30' can be cleaned even though the fabric web remains threaded on the rollers. The upper cleaning elements 40 act on the top sides of the guide rollers 30', under which the fabric web is guided, while the cleaning element 50 acts on the undersides of the guide rollers 20, over which the web is guided. In this manner, pulling the fabric web 10 forward by a distance that corresponds to the periphery of a guide roller 20, 30' ensures that the entire surface of each roller is cleaned. The cleaning elements 40, 50 may run back and forth along row 8 once or several times.

Instead of providing each individual guide roller 20, 30' with its own side-mounted nozzle 18, a nozzle may be provied with each individual cleaning element. As is indicated in FIG. 1 at 22, this nozzle may be arranged with the cleaning element on a common slide to be pulled forward by the chains 16, 17 together with the cleaning element.

If the steamer 100 is run empty before cleaning, i.e., if the web 10 is conducted out of the housing 1, instead of two cleaning elements 40, 50 associated with row 8, only one such cleaning element may be provided. One cleaning element then can reach all guide rollers from one side because no portion of the rollers is covered up by the fabric web 10 or by a corresponding lead or trail portion in the manner shown from FIG. 2.

In addition, the lower guide rollers 30 may be designed not to be pulled up as previously described, but rather to remain fixed in their position shown in FIG. 1. In this case the lower row 9 is provided with a cleaning element 60, which is movable along a horizontal path by a drive chain 19 to clean the lower guide rollers 30. With this construction, the steamer 100 must be run empty before cleaning to ensure the entire circumference of the rollers 30 is cleaned. Similarily, in this case only one cleaning element need be provided for the upper row 8. As with the cleaning element 60, this cleaning element may run either above or below one of the rows 8, 9.

In the embodiment illustrated in FIG. 1, the cleaning elements 40, 50, 60 may comprise cylindrical brushes rotating about their respective longitudinal axes that have radial or almost radial individual bristle parts. Alternatively, cylindrical bodies having a foam material covering may be used, such as shown in FIG. 2 at 70. Cleaning element 70 comprises a foam covering 19 that is applied onto a driven, roll type inner body 21 to exert a cleaning wiping action on the periphery of the guide roller 20 not covered by the fabric web 10. With this type of cleaning element, the lateral nozzle 18 lies outside the vertical plane passing through the axis of the guide roller 20 and sprays, as shown in FIG. 2, from the right into the wedge-shaped space or gore formed by the guide roller 20 and the cleaning element 70.

The cleaning elements 40, 50, 60, 70 are elastically flexible at their circumference such that they can be moved past the guide rollers at a distance that is a little less than the distance that corresponds to the sum of the radii of guide rollers and cleaning elements. The circumferential speeds of the guide rollers and cleaning elements may differ to produce a marked scraping or wiping effect.

Figure 3:
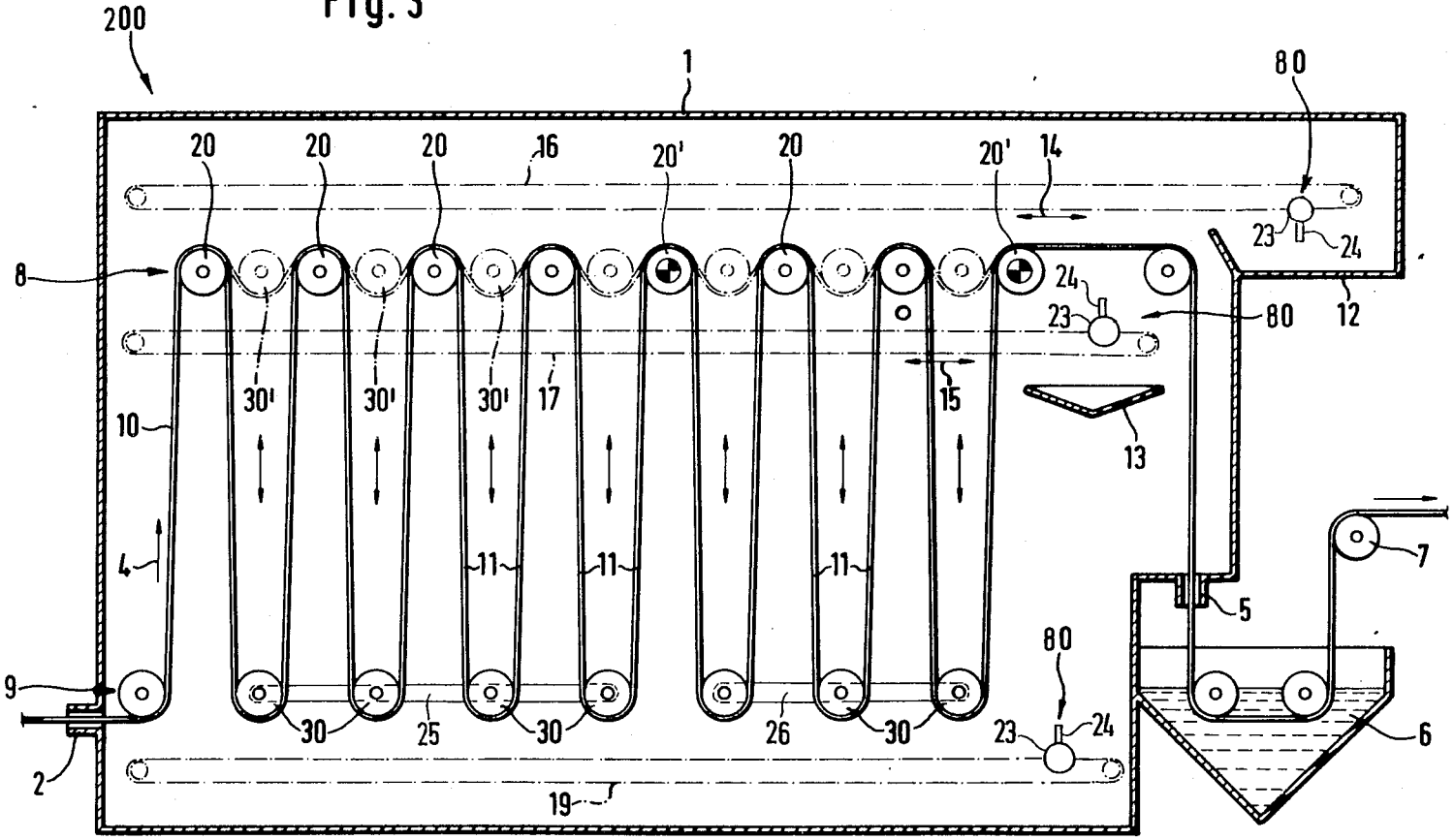
FIG. 3 shows a view corresponding to FIG. 1 of another embodiment of the invention.

In the embodiment of steamer 200 shown in FIG. 3, nozzle arrangements 80 are provided, instead of the rotating cleaning elements 40, 50, 60, 70. The nozzle arrangements 80 are movable by the respective drive chains 16, 17 and 19 along the rows 8, 9 of the guide rollers 20, 30 in the same manner as the cleaning elements 40, 50, 60, 70. The nozzle arrangements 80 comprise nozzle pipes 23 extending parallel to, and over the length of, the guide rollers 20, 30. Nozzle pipes 23 support a parallel row of individual nozzles 24 that may comprise small pipe sections or slits in nozzle pipe 23 to spray water, which may contain a suitable cleaning agent if desired, directly against the guide rollers 20, 30. The action of the cleaning elements 80, just like the action of the other previously described cleaning elements, is essentially uniform over the length of the guide rollers 20, 30.

If the cleaning is carried out with lower guide rollers 30 pulled up into position 30', i.e., with the fabric web 10 drawn in, the fabric web 10 is slowly moved onward to slowly rotate the guide rollers 20, 30 such that the entire circumferential area of the guide rollers may be cleaned. If cleaning occurs with the steamer run empty, the guide rollers 20, 30 may be set in rotation by the cleaning jets issuing from the nozzles 24 as long as the cleaning jets are not exactly centered over on the guide rollers 20, 30. Thereby, with this type of operation, the cleaning covers the entire circumference of the guide rollers.

FIG. 3 illustrates how a compensator which does not block the path of the cleaning elements 24 can be accommodated in steamer 200. In this illustrated embodiment, the fifth and eighth guide rollers 20' of the upper row 8 are rotatably driven in a controlled manner by conventional drive means. The four lower guide rollers 30 preceding the fifth upper guide roller 20' in the running direction of the web 10 are mounted in a common frame to be pulled up or lowered jointly. Hence, they can execute a common compensation movement to adjust web tension by adjusting the rate of advance of the drive means of the fifth upper guide roller 20'. The first four lower guide rollers 30 and the fifth upper guide roller 20' together form a group compensator. The fifth to seventh lower guide rollers 30 may be supported on a common frame 26 to form another group compensator with the driven eighth upper guide roller 20'. When compensation is provided and the cleaning operation begins, the entire arrangement of the lower guide rollers 30 with the frames 25, 26 is pulled up to avoid impeding the travel of the cleaning elements disposed below the upper row 8. The compensation feature may also be provided in the embodiment illustrated in FIG. 1.

What is claimed is:

1. A steaming apparatus for textile webs having a housing containing at least one row of mutually parallel guide rollers around which a textile web is passed, a cleaning device associated with said at least one row to clean the periphery of the guide rollers, said cleaning device comprising a cleaning element supported for movement along said at least one row of guide rollers over the length of the guide rollers in a direction transverse to the longitudinally axes of the mutually parallel guide rollers, said cleaning element being movable from an active position directly above or below the guide rollers to an inactive position.

2. Apparatus according to claim 1 wherein the cleaning element lies outside said at least one row of guide rollers in the inactive position.

3. Apparatus according to claim 2 further comprising a catch basin arranged under the cleaning element when the cleaning element is in the inactive position.

4. Apparatus according to claim 1 wherein the cleaning element is generally oblong in shape and extends over the length of the guide rollers in a direction parallel to the longitudinal axes of the guide rollers.

5. Apparatus according to claim 1 wherein the cleaning element is mounted for rotation such that the cleaning element rotates about an axis parallel to the longitudinal axes of the guide rollers and is movable by a drive chain along a path in which the periphery of the cleaning element abuts against the guide rollers.

6. Apparatus according to claim 5 wherein the cleaning element comprises a rotating brush.

7. Apparatus according to claim 5 wherein the cleaning element comprises a rotating body having a foam material covering.

8. Apparatus according to claim 5 further comprising a nozzle arrangement fixedly mounted in the housing associated with the cleaning element whereby a cleaning fluid may be sprayed from the nozzle arrangement onto the guide rollers to be cleaned.

9. Appratus according to claim 1 wherein the cleaning element comprises a nozzle arrangement extending over the length of the guide rollers in a direction parallel to the longitudinal axes of the guide rollers, said nozzle arrangement comprises a pipe extending across the width of the housing.

10. Apparatus according to claim 1 wherein said at least one row of guide rollers is horizontally disposed and said cleaning element comprises a first cleaning element supported for movement above said at least one row and a second cleaning element supported for movement below said at least one row.

11. Apparatus according to claim 10 wherein said at least one row of guide rollers comprises first and second horizontal rows of guide rollers with said first row being disposed above said second row, said first cleaning element being movable above said first row and said second cleaning element being movable below said second row.

12. Apparatus according to claim 11 further comprising a third cleaning element supported for movement below said first row of guide rollers.

13. A steaming apparatus for textile webs having a housing containing at least one row of mutually parallel guide rollers around which a textile web is passed, a cleaning device associated with said at least one row to clean the periphery of the guide rollers, said cleaning device comprising a cleaning element supported for movement along said at least one row of guide rollers over the length of the guide rollers in a direction transverse to the longitudinal axes of the mutually parallel guide rollers, said cleaning element being movable by a drive chain along a path parallel to said at least one row of guide rollers.

14. A steaming apparatus for textile webs having a housing containing at least one row of mutually parallel guide rollers around which a textile web is passed, a cleaning device associated with said at least one row to clean the periphery of the guide rollers, said cleaning device comprising:

a cleaning element supported for movement along said at least one row of guide rollers over the length of the guide rollers in a direction transverse to the longitudinal axes of the mutually parallel guide rollers, said cleaning element being mounted for rotation such that the cleaning element rotates about an axis parallel to the longitudinal axes of the guide rollers and is movable by a drive chain along a path in which the periphery of the cleaning element abuts against the guide rollers; and a nozzle arrangement supported for movement with the cleaning element along said at least one row of guide rollers.

15. A steaming apparatus for textile webs having a housing containing first and second horizontal rows of mutually parallel guide rollers around which a textile web is passed, said second row being movable from a steaming position below said first row to a cleaning position in which the guide rollers of said second row are disposed between the guide rollers of said first row in a position coplanar therewith, a cleaning device associated with said first and second horizontal rows to clean the periphery of the guide rollers, said cleaning device comprising a cleaning element supported for movement along said said first and second rows of horizontal guide rollers, when the first and second horizontal rows are in the cleaning position, over the length of the guide rollers in a direction transverse to the longitudinal axes of the mutually parallel guide rollers.

16. Apparatus according to claim 15 further comprising means for rotatably driving at least one guide roller of the first row in a controllable manner, a frame connecting a plurality of the guide rolls of said second row that precede said at least one guide roller of the first row in the running direction of the fabric web to form a group compensator vertically movable relative to said first row to adjust the web tension.

17. Apparatus according to claim 15 wherein said cleaning element is movable above said first horizontal row.

18. Apparatus according to claim 15 wherein said cleaning element is movable below said first and second horizontal rows when the rows are in the cleaning position.

19. Apparatus according to claim 15 wherein said cleaning element comprises a first cleaning element movable above said first horizontal row and a second cleaning element movable below said first and second horizontal rows when the rows are in the cleaning position.

* * * * *